US008191281B2

(12) United States Patent
Horiba et al.

(10) Patent No.: US 8,191,281 B2
(45) Date of Patent: Jun. 5, 2012

(54) METHOD OF DRYING HONEYCOMB FORMED ARTICLE

(75) Inventors: Yasuhiro Horiba, Nagoya (JP); Hiromi Shimada, Nagoya (JP); Yohei Takemori, Nagoya (JP); Shinzou Hayashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 219 days.

(21) Appl. No.: 12/552,755

(22) Filed: Sep. 2, 2009

(65) Prior Publication Data

US 2009/0313846 A1 Dec. 24, 2009

Related U.S. Application Data

(63) Continuation of application No. PCT/JP2008/053626, filed on Feb. 29, 2008.

(30) Foreign Application Priority Data

Mar. 28, 2007 (JP) ..... 2007-084053

(51) Int. Cl.
*F26B 3/347* (2006.01)

(52) U.S. Cl. ..... 34/245; 34/259; 34/381; 34/437

(58) Field of Classification Search ..... 4/245, 259, 4/265, 380, 381, 437, 438; 34/245, 259, 34/265, 380, 381, 437, 438
See application file for complete search history.

(56) References Cited

U.S. PATENT DOCUMENTS

| | | | | |
|---|---|---|---|---|
| 5,513,447 | A | 5/1996 | Yoshida | |
| 2002/0093123 | A1 | 7/2002 | Miura et al. | |
| 2002/0109269 | A1 | 8/2002 | Miura et al. | |
| 2003/0102602 | A1 * | 6/2003 | Miura | 264/489 |
| 2007/0006480 | A1 | 1/2007 | Ishii et al. | |

FOREIGN PATENT DOCUMENTS

| | | |
|---|---|---|
| JP | A 2-233551 | 9/1990 |
| JP | A-07-246613 | 9/1995 |
| JP | A-2002-283329 | 10/2002 |
| JP | A-2002-283330 | 10/2002 |
| JP | A-2006-308137 | 11/2006 |
| WO | WO 2005/023503 A1 | 3/2005 |

OTHER PUBLICATIONS

Extended European Search Report issued in European Patent Application No. 08712148.9; mailed Dec. 9, 2011.

* cited by examiner

*Primary Examiner* — Jiping Lu
(74) *Attorney, Agent, or Firm* — Oliff & Berridge, PLC

(57) ABSTRACT

A method of drying a honeycomb formed article, in which the honeycomb formed article can be dried in a short time while prohibiting occurrence of defects such as deformation, breakage and the like. There is provided a drying method of an unfired honeycomb formed article including raw material composition containing ceramics raw material, water, and binder, and having a plurality of cells, the cells being separated by partition walls to be passage of fluid, and electromagnetic wave drying is performed to dry the honeycomb formed article after the honeycomb formed article is preheated by steam.

1 Claim, 4 Drawing Sheets

METHOD OF DRYING HONEYCOMB FORMED ARTICLE

This is a Continuation of International Application No. PCT/JP2008/053626 filed Feb. 29, 2008, which claims the benefit of Japanese Patent Application No. 2007-084053 filed Mar. 28, 2007. The disclosure of the prior applications is hereby incorporated by reference herein in its entirety.

TECHNICAL FIELD

The present invention relates to a drying method of a honeycomb formed article which is an unfired article of a honeycomb structure.

BACKGROUND ART

A honeycomb structure is widely used for catalyst carrier, various types of filter, and the like. Recently, the honeycomb structure attracts attention as a diesel particulate filter (DPF) for trapping particulate matter emitted from diesel engines.

Generally, a principal component of the honeycomb structure is ceramics in many cases. To fabricate such a honeycomb structure, firstly water and various additives such as binder are added to raw material of ceramics to prepare kneaded clay, then a formed article with a shape of honeycomb (honeycomb formed article) is made through extrusion forming. After drying the honeycomb formed article, this honeycomb formed article is fired and then fabrication of the honeycomb structure can be achieved.

As drying methods of the honeycomb formed article: an dielectric drying method, which uses high frequency energy generated by current between electrodes provided upper and lower part of the honeycomb formed article; and a hot air drying method, which performs drying through introducing hot air generated by gas burner and the like, are well known. However in these days, in place of or in addition to these drying methods, a drying method utilizing microwaves (microwaves drying method), which has advantages of quick drying speed and the like (for example, refer to Patent Documents 1 to 3) has been adopted.

However, such microwave drying method has had difficulty in drying the whole honeycomb formed article in a uniform speed, due to delayed drying in the upper and lower end portion or in the peripheral portion of the honeycomb formed article compared with other portion in drying process. The honeycomb formed article shrinks when water evaporates whereby when drying speed is not uniform, defects such as deformation and breakage tend to happen easily. Moreover, thinning of partition wall (rib) to separate cells has been progressed and the thinner the partition wall of the honeycomb formed article is, the more easily deformation of the honeycomb formed article occurs. Consequently, uniformalizing of drying speed has especially become to be an important object recently.

Patent Document 1: JP-A 2002-283329

Patent Document 2: JP-A 2002-283330

Patent Document 3: WO 2005/023503 Pamphlet

DISCLOSURE OF THE INVENTION

The present invention has been developed in view of the foregoing problems in the prior art and the object is to provide a method of drying a honeycomb formed article with which a honeycomb formed article can be dried within a shortened period of time while inhibiting any occurrence of defects such as deformation and breakage.

According to the present invention, it is provided a drying method of an unfired honeycomb formed article including raw material composition containing ceramics raw material, water, and binder, and having a plurality of cells, the cells being separated by partition walls to be passage of fluid, wherein electromagnetic wave drying is performed to dry the honeycomb formed article, after the honeycomb formed article is preheated by steam.

In the present invention, it is preferred that the binder has heat gelation characteristic or thermosetting characteristic.

According to the present invention, the honeycomb formed article can be dried in a shortened time, while inhibiting any occurrence of defects such as deformation and breakage.

DESCRIPTION OF REFERENCE NUMERALS

1: honeycomb formed article, 2: partition wall, 3: cell, 4: external peripheral wall, 10: honeycomb formed article, 11: continuous feed microwave drying apparatus, 12: inlet, 14: conveyer belt, 16: wave guide, 18: outlet, 20: feeding pallet

DESCRIPTION OF THE PREFERRED EMBODIMENT

Hereinafter, preferable embodiments of the present invention will be described. However, the present invention is not limited to the following embodiments and it should be understood that the following embodiments that are suitably modified or improved without departing from the gist of the present invention based on knowledge of a person skilled in the art are included in the scope of the present invention.

In drying method of a honeycomb formed article according to the present invention, after the honeycomb formed article is preheated by steam, the electromagnetic drying is performed. Hereinafter, the detail explanation will be given.

Figure 1:
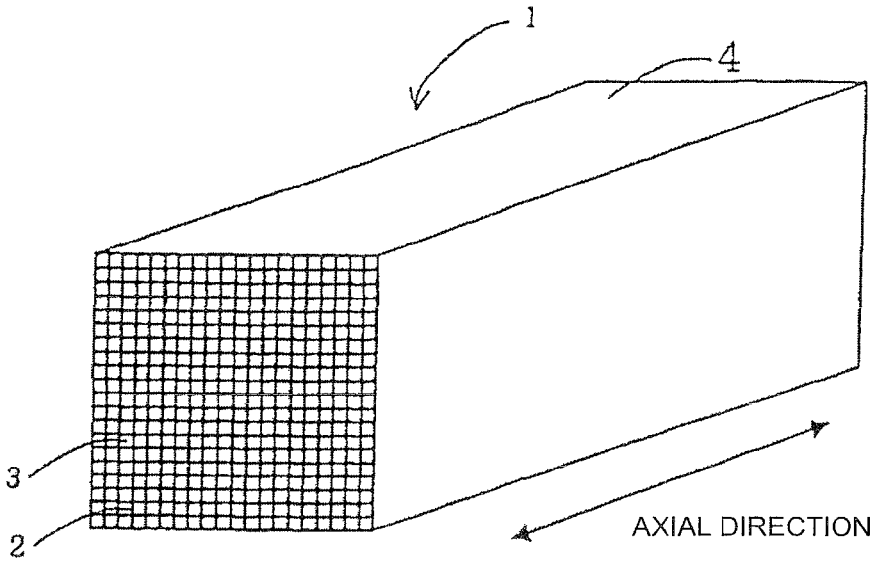
FIG. 1 is a perspective view showing an example of a honeycomb formed article which is used in a drying method of the honeycomb formed article according to the present invention.
Figure 2:
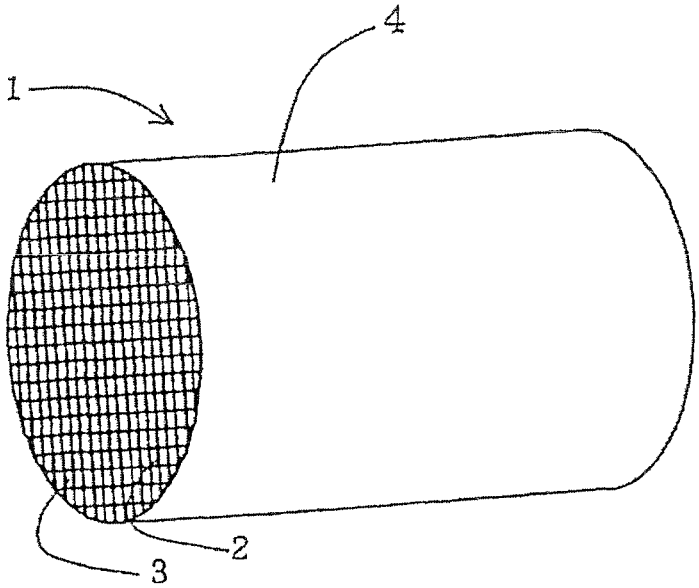
FIG. 2 is a perspective view showing another example of a honeycomb formed article which is used in a drying method of the honeycomb formed article according to the present invention.

In the drying method according to the present invention, the honeycomb formed article to be dried is, for example, the one which has such structure as shown in FIG. 1 and FIG. 2. That is, the honeycomb formed article 1 is provided with a plurality of cells which are fluid passages separated by the partition walls 2. Moreover, the honeycomb formed article 1 includes generally peripheral wall 4 which is provided to enclose a plurality of cells 3. The sectional shape perpendicular to the axial direction of the cell 3 (passage direction) is not limited and any shape can be selected including a quadrilateral as shown in FIG. 1, a circle as shown in FIG. 2 and the like.

The honeycomb formed article is an unfired article including raw material composition which contains ceramics raw material, water, and binder. As ceramics raw material, for example, oxide-type ceramics such as alumina, mullite, zirconia, cordierite and the like; and non-oxide type ceramics such as silicon carbide, silicon nitride, aluminum nitride, and the like can be mentioned. In addition, silicon carbide/metallic silicon composite material and silicon carbide/graphite composite material and the like can be used as well.

As binder having heat gelation characteristic and thermosetting characteristic, which is included in the ceramics formed article that is the object of the present invention, for example, methylcellulose, hydroxypropylmethylcellulose, carboxymethyl-cellulose, hydroxyethylcellulose, hydroxyethylmethylcellulose, and the like can be mentioned. Among which, methylcellulose is used most prevalently. Gelation temperature of these gelation binder depends on types but it is approximately 50 to 80° C. and about 55° C. for methylcellulose. Different types of gelation binder can be used in mixture.

In drying operation of the honeycomb formed article having the aforementioned constitution, the honeycomb formed article is preheated by steam and thereafter, according to the present invention, electromagnetic wave drying is performed.

Preheating of the honeycomb formed article can be carried out through such an arrangement as steam is passed through cells of the honeycomb formed article. Temperature of steam passing through the cells is preferably 70 to 100° C., and more preferably 80 to 100° C. When the temperature of steam passing through the cells is lower than 70° C., heating of the honeycomb formed article is not sufficient, although the honeycomb formed article is heated, and such defects as deformation, uneven water distribution in the electromagnetic wave drying tends to be occurred. Optimal temperature of steam is not determined to be a single value but should be modified corresponding to type of ceramics and type of binder.

Duration time of steam which is arranged to pass through the cells, that is the required time to get equilibrium state of the honeycomb formed article temperature, varies depending on: the shape, contained water or size of the honeycomb formed article; and volume of steam arranged to pass through. In general, it is 10 to 600 seconds, preferably more or less 10 to 120 seconds. When the duration time of steam which is arranged to pass through the cells is too short, sometimes equilibrium state is not achieved. Optimal duration time of steam which is arranged to pass through the cells is not determined by a single value but it should be modified corresponding to type, shape, contained water, size, and the like, of ceramics, or volume of steam arranged to pass through.

Next, the preheated honeycomb formed article is dried by electromagnetic wave. The electromagnetic wave drying is a general term covering the microwave drying and the dielectric drying. The microwave drying stands for such heating and drying operation that a target article (honeycomb formed article in the present invention) is heated and dried by electromagnetic energy of microwave (electromagnetic wave, wave length of which is between 1 cm and 1 m (frequency of which is between 300 MHz and 30 GHz)). The dielectric drying stands for a drying method in which the article is heated and dried from the inside thereof by the internal dielectric loss through flow of electricity of high frequency current (high frequency current about 2 to 100 MHz is used) between electrodes provided upper and lower part of the target article, and the target article is heated and dried in proportion to the electric field distribution inside of the target article.

When a preheated honeycomb formed article is dried by the electromagnetic wave drying, the penetration depth of the electromagnetic wave becomes deeper compared with non-preheated one, and hence uniform drying of the honeycomb formed article can be achieved. In addition, when the honeycomb formed article is preheated, binder in the honeycomb formed article is gelated to enhance the strength of the honeycomb formed article. When electromagnetic wave drying is performed after that, the honeycomb formed article with good quality without any occurrence of deformation or cut can be obtained.

Figure 7:
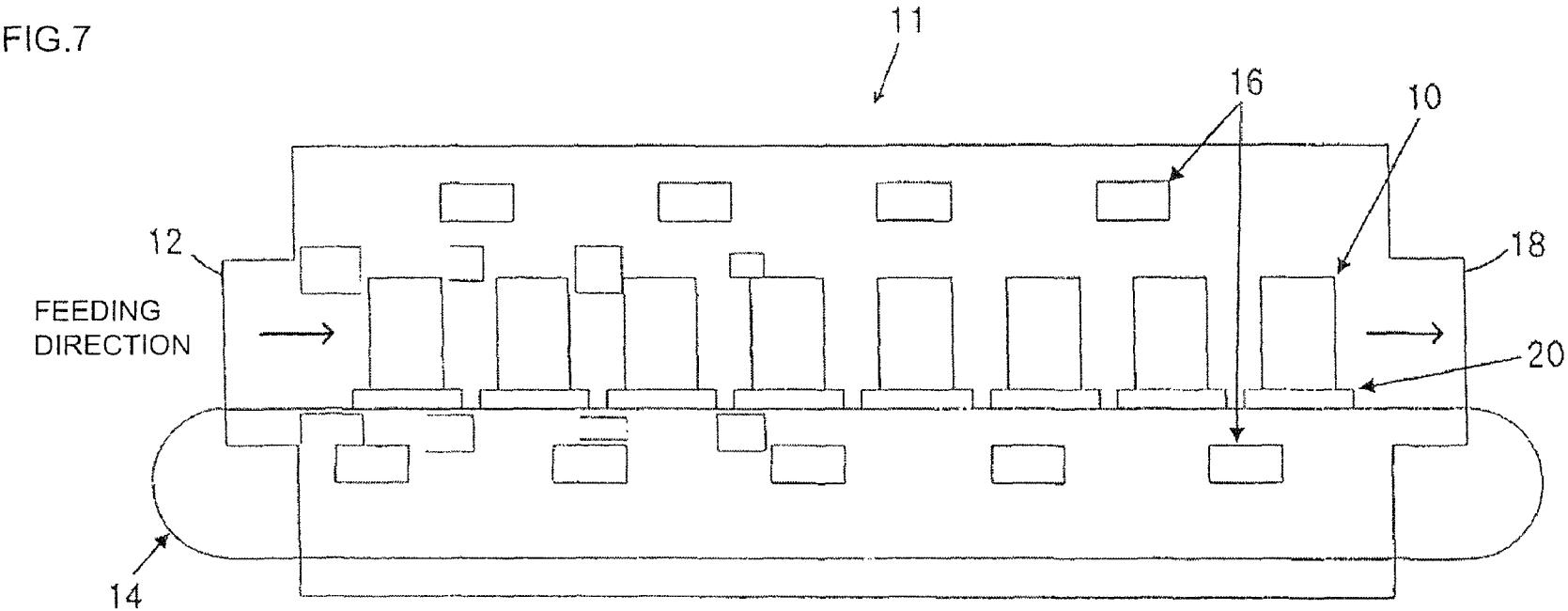
FIG. 7 is a schematic side view of an example of continuous feed microwave drying apparatus.

As for the electromagnetic wave drying, as shown in FIG. 7 for example, a continuous microwave drying apparatus can be used to perform drying. In the continuous microwave drying apparatus 11 of FIG. 7, the honeycomb formed article 10 is fed into the apparatus from the inlet 12, being placed on a feeding pallet 20 which is located on the conveyer belt 14. While the honeycomb formed article 10 is moving in the apparatus at a predetermined feeding speed, microwave is irradiated for a predetermined duration which is emitted from the wave guide 16 disposed in upper part of the apparatus so that the honeycomb formed article is dried and fed out from the outlet 18.

Cell density, thickness of partition wall, shape of cell, size, and the like of the honeycomb formed article which is the target article in drying method of the present invention is not specifically limited. The drying method is especially effective to dry the honeycomb formed article with thin partition walls which tends to cause deformation and the like (for example, thickness of partition wall: 150 μm or less), or large sized honeycomb formed article which tends to cause different drying speed in each part (for example, total length of passage: 200 to 1000 mm, outside diameter: 150 to 600 mm).

EXAMPLES

Hereinafter, the present invention will be described specifically based on examples. However, the present invention is not limited to these examples.

Example 1

Figure 4:
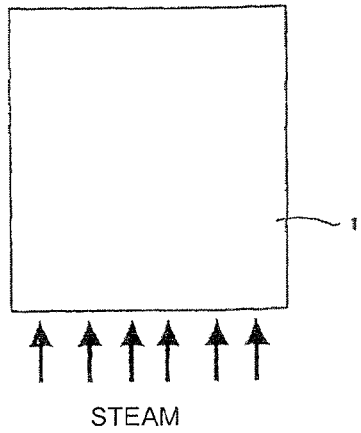
FIG. 4 is an explanation diagram showing an example of heating of the honeycomb formed article by passing steam through from lower part thereof.

A honeycomb formed article having outer shape shown in FIG. 2 which is fabricated using ceramics raw material of cordierite-type oxide, ceramics raw material of silicon carbide-type non-oxide, and forming auxiliary agent of methylcellulose (MC) as binder is prepared [(cordierite-type oxide ceramics formed article: outside diameter×passage length: 106 mmϕ×220 mm, number of cells: 93 cells/cm$^2$, thickness of partition wall: 64 μm), (silicon carbide-type non-oxide ceramics formed article: outside diameter×passage length: 35 mm (section is regular square)×330 mm, number of cells: 31 cells/cm$^2$, thickness of partition wall: 381 μm)]. For the prepared honeycomb formed article (carrier), as shown in FIG. 4, steam (temperature: 100° C.) was arranged to pass through the cells from the lower part towards the upper direction to heat the honeycomb formed article 1. By the way, steam volume for the cordierite-type material was set at 50 kg/hr, meanwhile steam volume for the silicon carbide-type was set at 20 kg/hr, and the preheating tact time for each material was adjusted to be 20 seconds or less.

Figure 3:
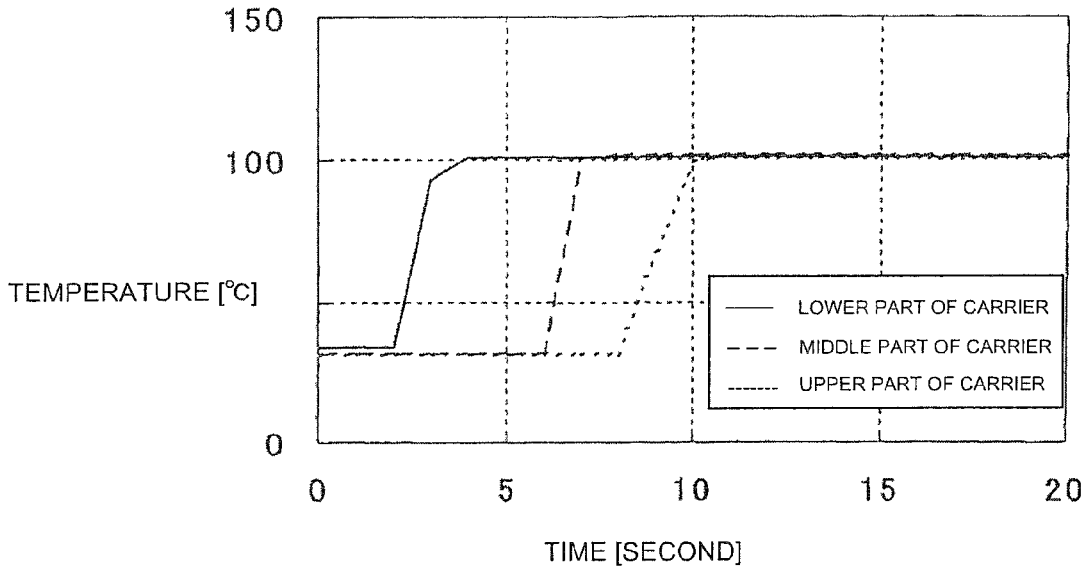
FIG. 3 is a graph showing temperature variation versus drying time of the honeycomb formed article.

Temperature variation versus drying time of the honeycomb formed article is shown in FIG. 3. As evident from FIG.

3, it is obvious that the temperature of the upper part, middle part, and lower part of the honeycomb formed article becomes uniform within 10 seconds.

Example 2

Figure 5:
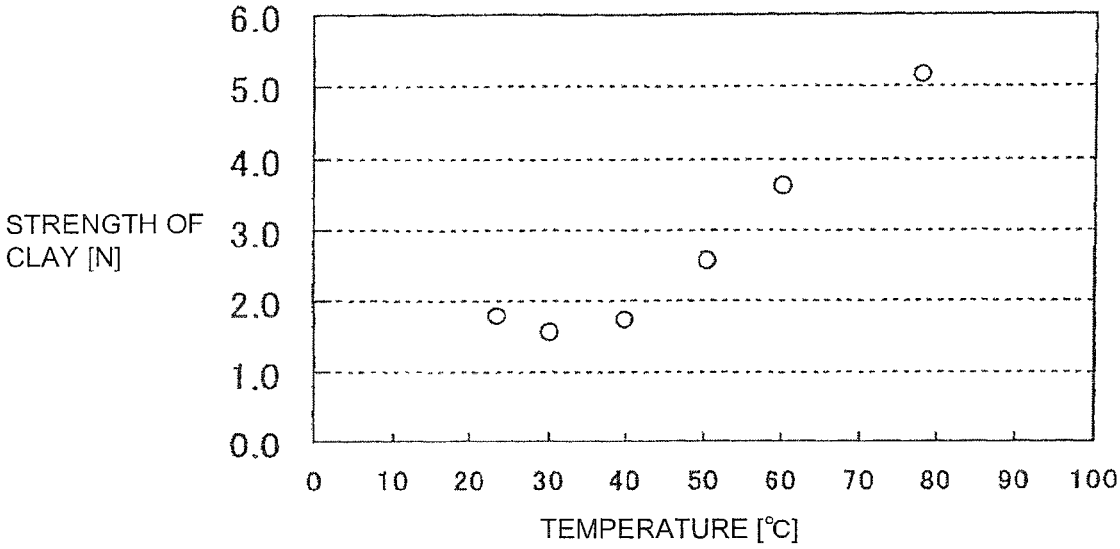
FIG. 5 is a graph showing strength variation of the honeycomb formed article versus temperature of the honeycomb formed article.

A honeycomb formed article which has same material and shape as of the example 1 was fabricated and heated similarly to the example 1. Strength variation of the honeycomb formed article versus the temperature of the honeycomb formed article is shown in FIG. 5. As evident from FIG. 5, it was proved that the strength of the honeycomb formed article was increased when the honeycomb formed article was heated and the temperature of the honeycomb formed article exceeded 50° C. It becomes clear that binder such as methylcellulose in the honeycomb formed article was gelated due to heating, and thereby the strength of the honeycomb formed article was increased. Consequently, if electromagnetic wave drying is performed after that, it is possible to obtain dried honeycomb formed article of good quality without any occurrence of deformation or cut.

Example 3

Figure 6:
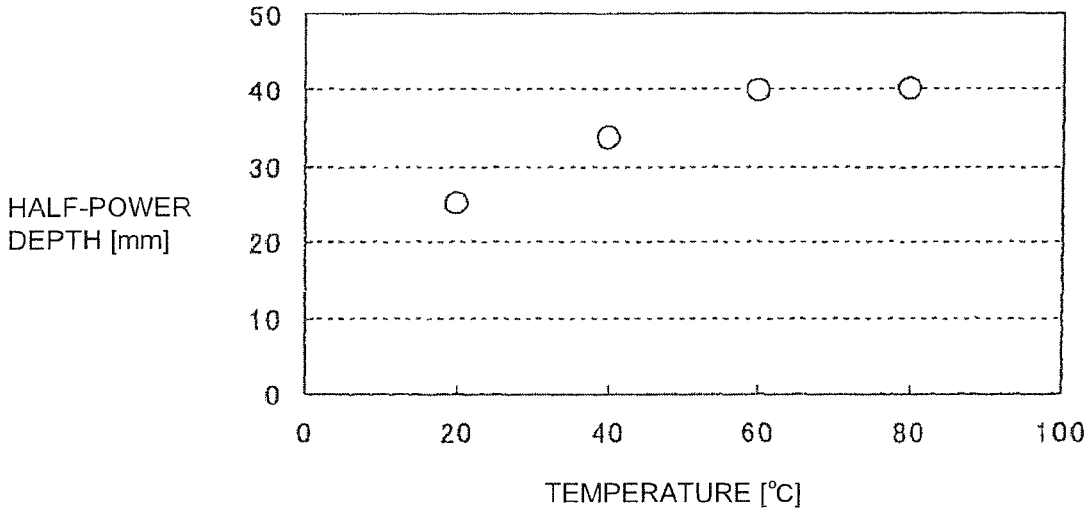
FIG. 6 is a graph showing half-power depth of microwave versus temperature of the honeycomb formed article.

A honeycomb formed article which has same material and shape as of the example 1 was fabricated and preheated similarly to the example 1 so that the whole of the honeycomb formed article was heated up to the uniform temperature. Subsequently, half-power depth of microwave was measured for the preheated honeycomb formed article in such manner. Obtained results are shown in FIG. 6. It is confirmed that the microwave penetration becomes deeper as the temperature of the honeycomb formed article rises. Whereby when electromagnetic wave drying is performed after preheating the honeycomb formed article, it is possible to achieve uniform drying of the honeycomb formed article compared with the case of no preheating. Note that, in the example 3, the continuous microwave drying apparatus was used to perform drying by irradiation of microwave for approximately 200 seconds, frequency of which was 2.45 GHz and the output density was 5 kW/kg. The feeding speed of the honeycomb formed article in the continuous microwave drying apparatus was set at 0.32 m/min. As a result, good quality dried honeycomb article was obtained without deformation or cut.

INDUSTRIAL APPLICABILITY

Drying method according to the present invention can preferably dry unfired article of honeycomb structure which is used widely for catalyst carrier and various filters such as DPF.

The invention claimed is:

1. A method of drying an unfired honeycomb formed article including a raw material composition containing ceramics raw material, water, and binder, the binder being provided with a heat gelation characteristic, and having a plurality of cells, the cells being separated by partition walls, the method comprising:

preheating the honeycomb formed article by passing steam through the plurality of cells at least until gelation of the binder and at least until the honeycomb formed article is heated to an equilibrium state;

controlling a time period of the preheating step to be within a range of approximately 10 to 120 seconds by controlling the volume of the steam; and subsequently drying the honeycomb formed article using electromagnetic waves.

* * * * *